US006745438B2

(12) United States Patent
Pferdmenges

(10) Patent No.: US 6,745,438 B2
(45) Date of Patent: Jun. 8, 2004

(54) FLAT BAR WITH ATTACHABLE CLOTHING SUPPORT

(75) Inventor: Gerd Pferdmenges, Jüchen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/292,431

(22) Filed: Nov. 13, 2002

(65) Prior Publication Data

US 2003/0070261 A1 Apr. 17, 2003

Related U.S. Application Data

(63) Continuation of application No. 10/247,746, filed on Sep. 20, 2002, now abandoned.

(30) Foreign Application Priority Data

Sep. 21, 2001 (DE) ..... 101 46 534
Mar. 30, 2002 (DE) ..... 102 14 390

(51) Int. Cl.[7] ..... D01G 15/12
(52) U.S. Cl. ..... 19/113; 19/114
(58) Field of Search ..... 19/98, 102, 104, 19/105, 108, 110, 111, 112, 113, 114, 115 R; 83/835, 836, 846, 847, 848, 851–855, 908; 140/97, 100

(56) References Cited

U.S. PATENT DOCUMENTS 4,221,023 A 9/1980 Henderson et al.
4,553,288 A * 11/1985 Schneider et al. ..... 19/113
4,996,745 A 3/1991 Sutcliffe
5,038,440 A * 8/1991 Demuth et al. ..... 19/114
5,467,505 A 11/1995 Graf
6,101,680 A 8/2000 Näf et al.

FOREIGN PATENT DOCUMENTS

| | | |
|---|---|---|
| DE | 1 105 318 | 4/1961 |
| DE | 2 128 620 | 12/1972 |
| DE | 21 28 620 A | 12/1972 |
| DE | 28 46 110 A1 | 4/1980 |
| DE | 88 16 485 U1 | 1/1990 |
| EP | 0 567 747 | 8/1997 |
| EP | 0 887 445 | 12/1998 |
| GB | 2323099 A | 9/1998 |
| GB | 2340848 A | 3/2000 |

OTHER PUBLICATIONS

U.S. patent application Publication, Wurst, Sep. 6, 2001.*

* cited by examiner

*Primary Examiner*—Gary L. Welch
(74) *Attorney, Agent, or Firm*—Venable LLP; Robert Kinberg; Stuart L. Smith

(57) ABSTRACT

A flat bar is provided for use in a carding machine having a roller with clothing. The flat bar is for arranging opposite the clothing on the roller. The flat bar has a flat bar support body having a recess, a clothing support having a first side, the first side being positioned in the recess, flat bar clothing attached to a second side of the clothing support, the second side being opposite the first side, and at least one fastening element that secures the first side of the clothing support in the recess.

22 Claims, 5 Drawing Sheets

FLAT BAR WITH ATTACHABLE CLOTHING SUPPORT

CROSS-REFERENCE TO RELATED APPLICATION

This is a continuation of U.S. patent application Ser. No. 10/247,746, filed Sep. 20, 2002 now abandoned. This application claims priority to German Patent Application No. 101 46 534.3, filed Sep. 21, 2001, and German Patent Application No. 102 14 390.0, filed Mar. 30, 2002, the disclosures of which are incorporated herein by reference.

BACKGROUND OF THE INVENTION

The invention relates to a device on, for example, a carding machine for cotton, synthetic fibers and the like. The device comprises at least one flat bar with flat bar clothing, where the flat bar clothing is attached to the flat bar and is positioned opposite clothing on, for example, a main carding cylinder of the carding machine.

The flat bar of a known device has of a back part and a support body with an underside. A clothing strip (flexible clothing) that extends in a longitudinal direction of the underside is attached to the underside. The clothing strip comprises a support element having several textile layers in which a plurality of small wire hooks or clothing needle points are fastened. The clothing strip is attached with the aid of two clamps, straps, or clips along the longitudinal sides of the support body. With one end, the clamps encircle the longitudinal edge regions of the clothing strip and, with the other end, they engage recesses in the support body. In practical operations, the clamps consist of a sheet-metal strip, one longitudinal edge of which is punched into the textile material. During assembly, the textile material of the clothing strip is attached with considerable tension and is form fitting to the support body of the flat bar. In the process, the clamps exert tensile stresses in such a way that the textile material is deformed spherically away from the underside. Thus, the clothing needle points are also arranged in an undesirable manner along a convex enveloping curve, pointing toward the outside.

A set of flat bars produced in this way has an accuracy of 0.05 mm in height and evenness when not in use. As a result of use, the height differences in the set will increase to approximately 0.2 mm. The accuracy is improved only insignificantly through a re-sharpening of the clothing on the machine. Following a fiber-material throughput of approximately 400 t, the flat bar clothing is worn to such a degree that it must be replaced. The flat bar is clamped in for dismantling the sheet metal straps and the form-locking connection is reversed with the aid of a lever and pliers. The considerable forces required for the assembly and dismantling negatively effect the dimensional stability of the flat bar. Added to this are undesirable tolerances resulting from the production of the flat bar body. As a result of the aforementioned disadvantages, the clothing needle points of the clothed flat bar must be leveled by grinding.

According to a previous solution (shown in European Patent 0 887 445), the clothing strip is attached to a support, for example the base of a steel band. The flat steel band base is inserted between guide grooves that open toward the inside, in the edge regions of the flat bar underside, thus fastening the clothing strip to the flat bar. The production of this flat bar is quite involved with respect to production technology and assembly. It is particularly bothersome that the steel band underside and the guide grooves must be produced to exact dimensions to offer sufficient support during the operation. In addition, this makes replacement more difficult.

SUMMARY OF THE INVENTION

In contrast to the above, it is an object of the invention to create a device of the above-described type that avoids the aforementioned disadvantages. In particular, the invention makes it possible to produce a clothed flat bar with inherently stable form and makes it easier to produce the flat bar and replace the clothing strip.

The production and replacement of the clothed flat bar is simplified because the outside of the support and the support body for the flat bar fit together form-fittingly and the support is furthermore secured in the recess with an additional fastening element. Tolerances resulting from the production of the flat bar and the clothing as well as assembly (including dismantling) are thus reduced or eliminated. With the clothed flat bar according to the invention, an addition of the tolerances resulting from the assembly and dismantling of the flat bar clothing, the technologically damaging leveling and the decrease in the accuracy during use are advantageously avoided.

Particular embodiments of the invention provide a flat bar for use in a carding machine having a roller with clothing. The flat bar is for arranging opposite the clothing on the roller. The flat bar has a flat bar support body having a recess, a clothing support having a first side, the first side being positioned in the recess, flat bar clothing attached to a second side of the clothing support, the second side being opposite the first side, and at least one fastening element that secures the first side of the clothing support in the recess.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
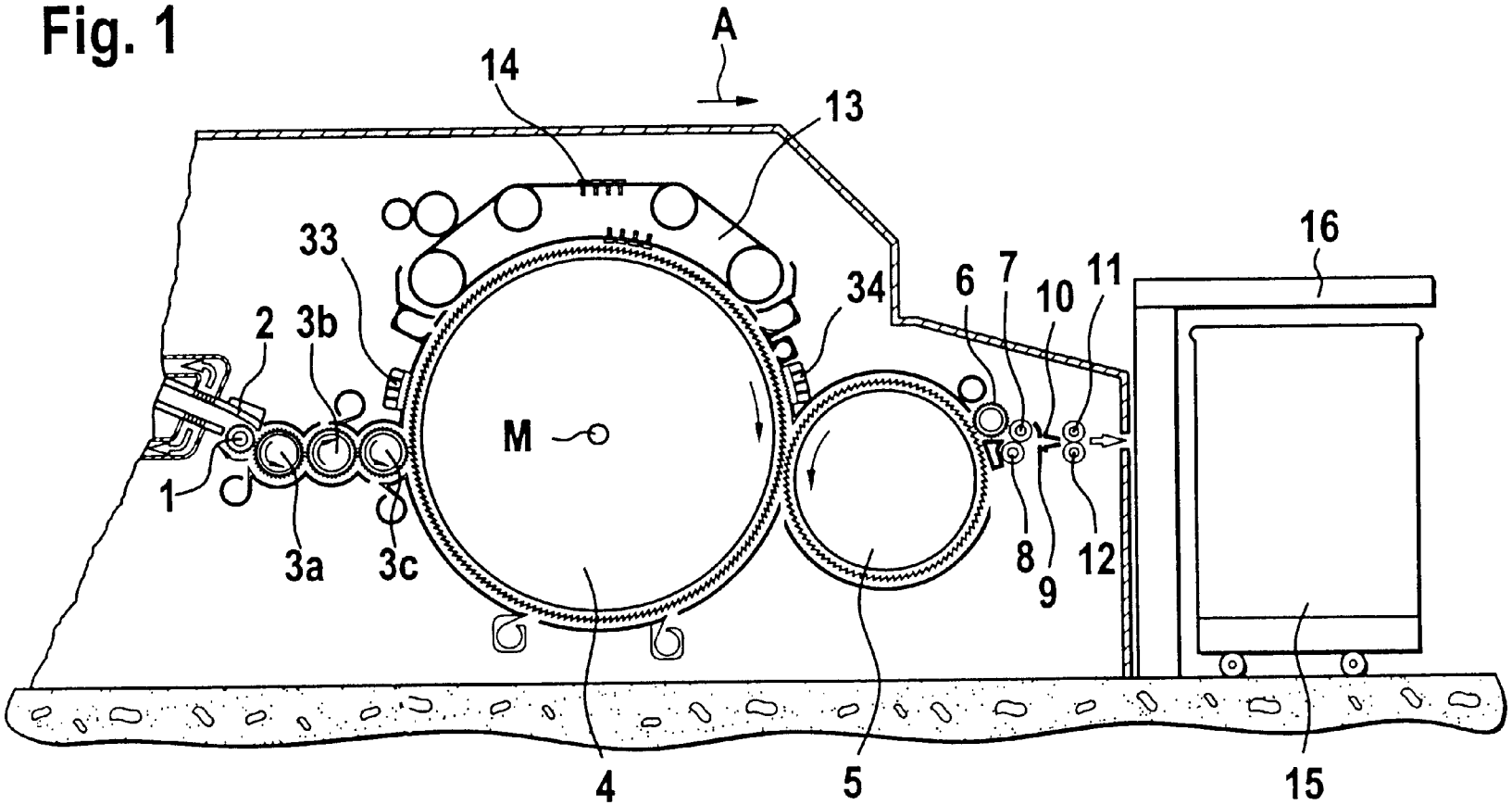
FIG. 1 is a schematic side elevation view of a device in accordance with the invention.

FIG. 1 shows a carding machine, for example a High-Performance Card DK 903 by the company Trützschler in M önchengladbach, Germany. The aforementioned carding machine comprises a feed roller 1, a feed table 2, licker-ins 3*a*, 3*b*, 3*c*, a main carding cylinder 4, a doffer 5, a stripping roller 6, crushing rollers 7, 8, a sliver guide element 9, a web trumpet 10, withdrawing rollers 11, 12, a set of traveling flats 13 with clothed flat bars 14, a can 15 and a can holder 16. Curved arrows indicate the rotational direction of the rollers while the letter A refers to the operating direction. Stationary carding elements 33 and 34 are arranged opposite clothing of the main carding cylinder 4.

Figure 2:
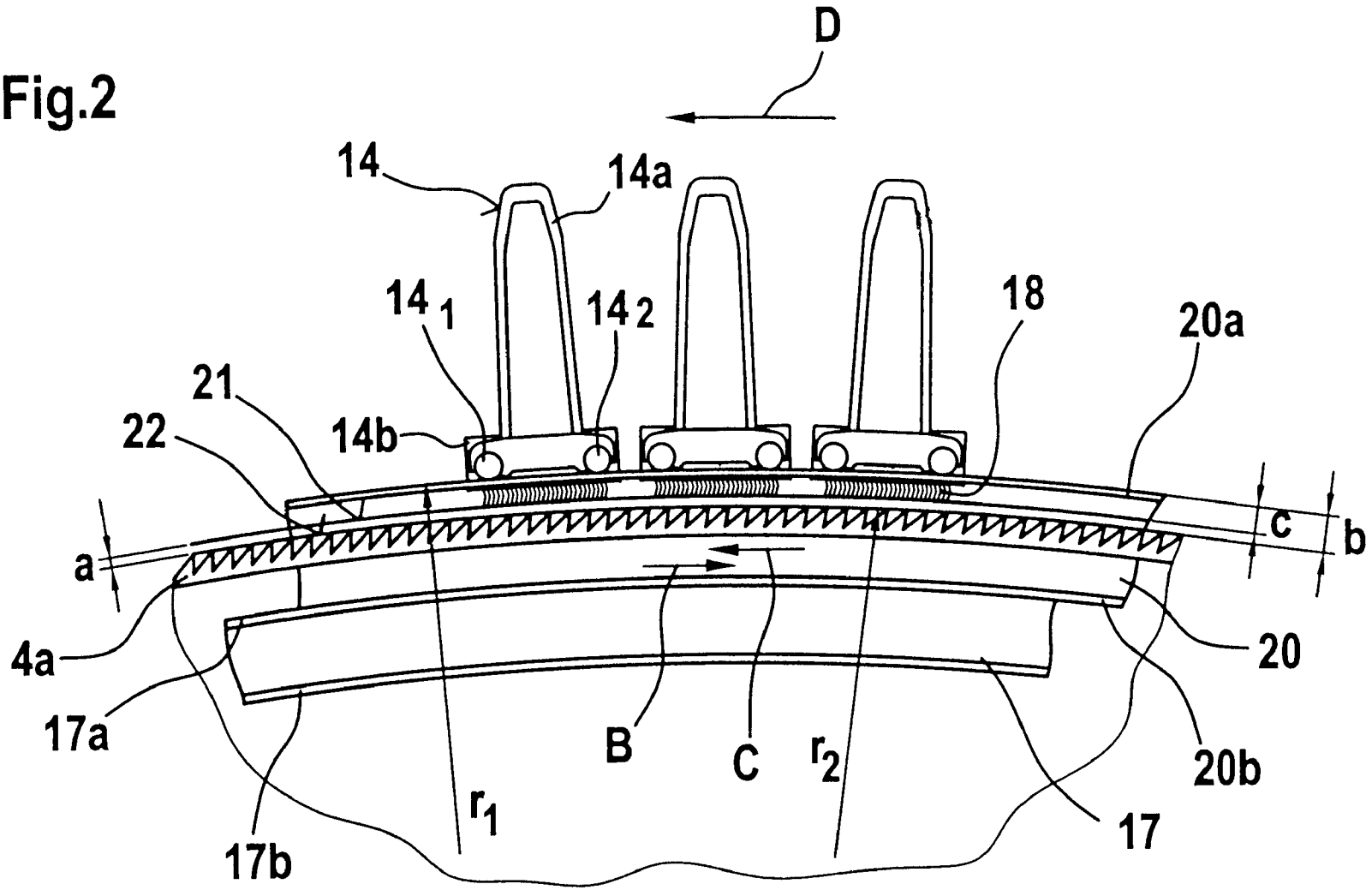
FIG. 2 is a partial side elevation view showing clothed flat bars, a sliding guide and a flexible bend, as well as the distance between the clothing on the flat bars and the clothing on the main carding cylinder.

FIG. 2 shows a flexible bend 17, provided with several adjustment screws, which is arranged on each side of the carding machine frame. The flexible bend 17 has a convex outside surface 17*a* and an underside 17*b*. A sliding guide 20, for example made of a plastic with sliding ability, with a convex outside surface 20*a* and a concave inside surface 20*b* is provided above the flexible bend 17. The concave inside surface 20*b* rests on the convex outside surface 17*a* and can slide along this surface in the direction of arrows B, C. Each flat bar, for example designed according to European Patent 0 567 747 A1, has a back part 14*a* and a support body 14*b*.

Figure 3A:
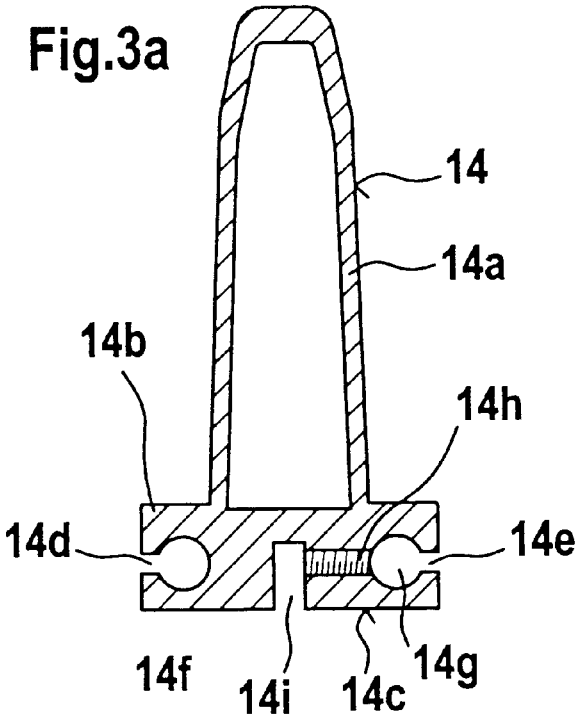
FIG. 3*a* is a side elevation view of a section through a flat bar with elongated slots, openings, bores and a longitudinal groove in the support body.

As shown in FIG. 3*a*, the support body 14*b* has an underside 14*c* and two side surfaces. Each flat bar 14 is provided on its two ends with respectively one flat bar head 14', 14" (see FIG. 6*a*) with respectively two steel pins $\mathbf{14}_1$, $\mathbf{14}_2$ or $\mathbf{14}_3$, $\mathbf{14}_4$ (see FIGS. 6*a* and 6*b*). These pins are fastened with a section, for example glued, in an axial direction in recesses of the support body 14*b*. As shown in FIG. 2, the sections of the steel pins $\mathbf{14}_1$, $\mathbf{14}_2$ that project over the front surfaces of the support body 14*b* slide along the convex outside surface 20*a* of the sliding guide 20 in the direction of arrow D.

Figure 3B:
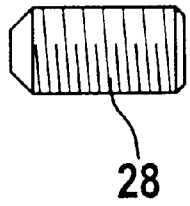
FIG. 3*b* shows a threaded pin.

A clothing strip 18 is attached to the underside 14*c* of the support body 14*b*. As shown in FIG. 3*d*, clothing strip 18 has a support element 23 of, for example, a textile material and flat bar clothing 19 having a plurality of points. Support element 23 has a thickness f. The flat bar clothing, for example wire needles, 19 extends through the surface of, and are attached in, the support element 23. The points on the other end of the clothing 19 are exposed. A circle 21 defined by the points of the flat bar clothing 19 is shown in FIG. 2. The main carding cylinder 4 is provided along its circumference with a clothing 4*a*, for example a saw-tooth clothing. A circle 22 defined by the points of the cylinder clothing 4*a* is shown in FIG. 2. The distance between the circle 21 and the circle 22, for example, amounts to 3/1000" and is given the reference a. The distance between the convex outside surface 20*a* and the circle 22 is given the reference b. The distance between the convex outside surface 20*a* and the circle 21 is given the reference c. The radius for the convex outside surface 20*a* is $r_1$ and the radius for the circle 22 is $r_2$. The radii $r_1$ and $r_2$ intersect in the center M of the main carding cylinder 4.

According to FIG. 3*a*, the support body 14*b* of the flat bar 14, which is, for example, extruded from aluminum, is provided across its width with two elongated slots 14*d* and 14*e* that are open toward the outside. These slots widen toward the center of the flat bar 14 to become hollow-cylindrical openings 14*f* and 14*g*. The respective region for fastening the flat bar pins $\mathbf{14}_1$, $\mathbf{14}_2$, $\mathbf{14}_3$, $\mathbf{14}_4$ is shown in the openings 14*f*, 14*g*. The center of the flat bar 14 contains a longitudinal groove 14*i* that is open toward the underside 14*c* and extends, for example, over the complete width of the flat bar. A plurality of through bores 14*h* exist between the opening 14*g* and the longitudinal groove 14*i* and extend essentially parallel to the underside 14*c*. The bores 14*h* are oriented perpendicular to the longitudinal groove 14*i*. The bores 14*h* are provided with internal threads that engage external threads of threaded pins 28 according to FIG. 3*b*.

Figure 3C:
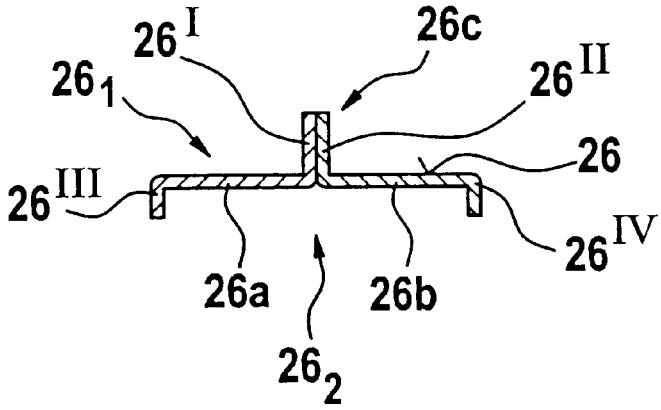
FIG. 3*c* is a side elevation view of the support.
Figure 3D:
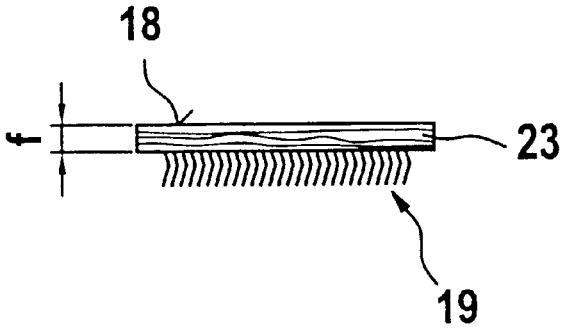
FIG. 3*d* is a side elevation view showing a section through a clothing strip.

A support 26 according to FIG. 3*c* has two sheet-metal strips 26*a*, 26*b*, the end regions of which are respectively bent at a right angle in the same direction. For example, the sheet-metal strip 26*a* is bent counter-clockwise and the sheet-metal strip 26*b* is bent clockwise. The bent regions $\mathbf{26}^{I}$ and $\mathbf{26}^{II}$ of sheet-metal strips 26*a* and 26*b* are, for example, laser-welded together and thus form an extension 26*c* that is fastened inside the longitudinal groove 14*i* (FIG. 3*a*). The bent regions $\mathbf{26}^{III}$ and $\mathbf{26}^{IV}$ serve to additionally hold the support element 23 of clothing strip 18.

Figure 4:
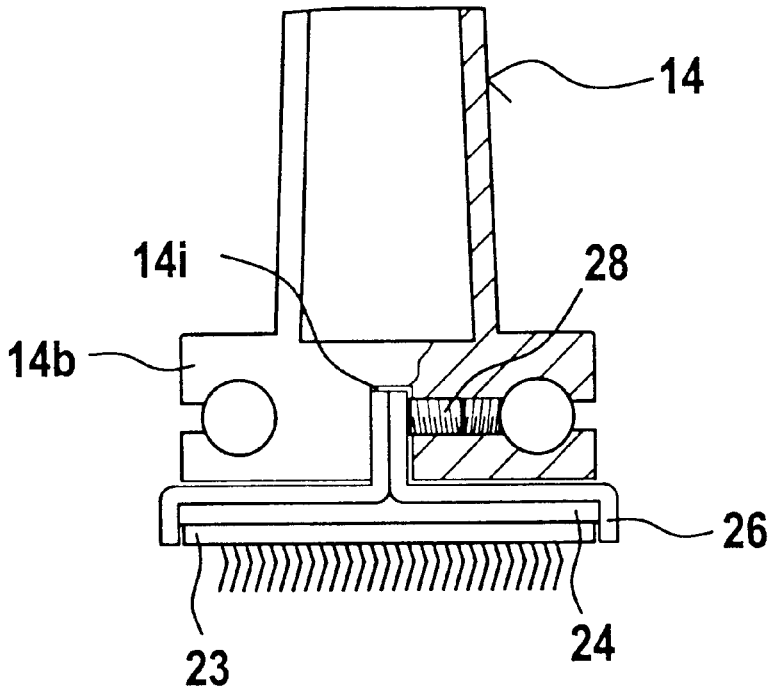
FIG. 4 shows a flat bar with a device according to the invention and an equalizing layer in the assembled state.

FIG. 4 shows the flat bar 14 according to FIGS. 3*a* to 3*d*, but in the fully assembled state. The clothing strip 18 is attached to one side $\mathbf{26}_2$ of the support 26, for example by gluing it on. The extension 26*c* of the support 26 is inserted into the longitudinal groove 14*i* of the support body 14*b*, so that the other side $\mathbf{26}_1$ of the support 26 and the support body 14*b* are connected. The screwed-in threaded pins 28 push the extension 26*c* against the opposite positioned inside wall of elongated slot 14*i*. As a result, the support 26 is attached to the flat bar 14. In addition to the elements shown in FIGS. 3*a* to 3*d*, FIG. 4 shows that an equalizing layer 24, for example made of a hardened synthetic resin or the like, is arranged between the inside surface $\mathbf{26}_2$ of the support and the support element 23. This equalizing layer 24 can equalize differences in the distances between the flat bar 14, namely the underside 14*c*, and the flat bar clothing 19, that is to say the enveloping curve for the exposed wire needle points.

Figure 5:
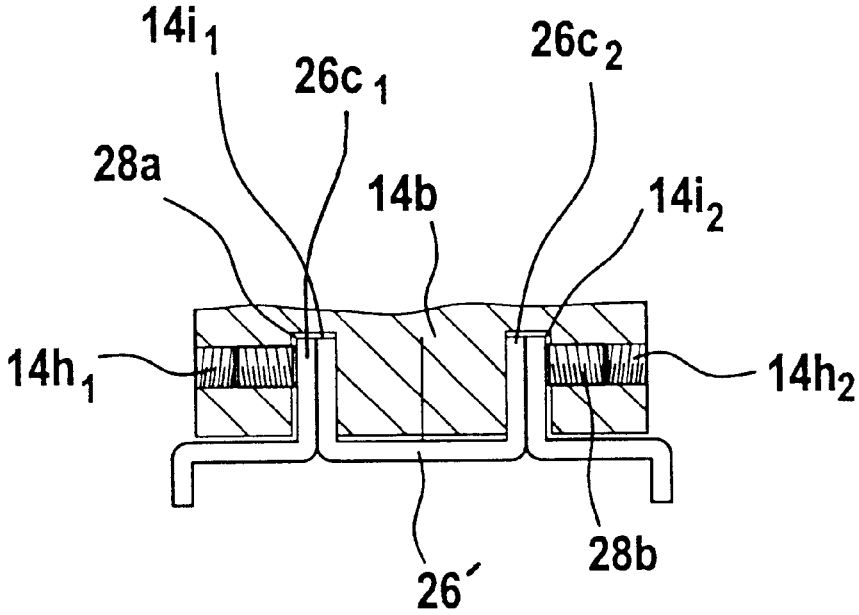
FIG. 5 shows an embodiment of the support with two projections and an embodiment of the support body with two longitudinal grooves.

In the embodiment shown in FIG. 5, the support body 14*b* contains two longitudinal grooves $\mathbf{14}i_1$ and $\mathbf{14}i_2$, into which two extensions $\mathbf{26}_{c1}$ and $\mathbf{26}_{c2}$ of support 26' engage. Extensions $\mathbf{26}_{c1}$ and $\mathbf{26}_{c2}$ are fastened with threaded pins 28*a* and 28*b*. The threaded pins 28*a* and 28*b* extend from opposite sides through the bores $\mathbf{14}h_1$ and $\mathbf{14}h_2$.

Figure 6A:
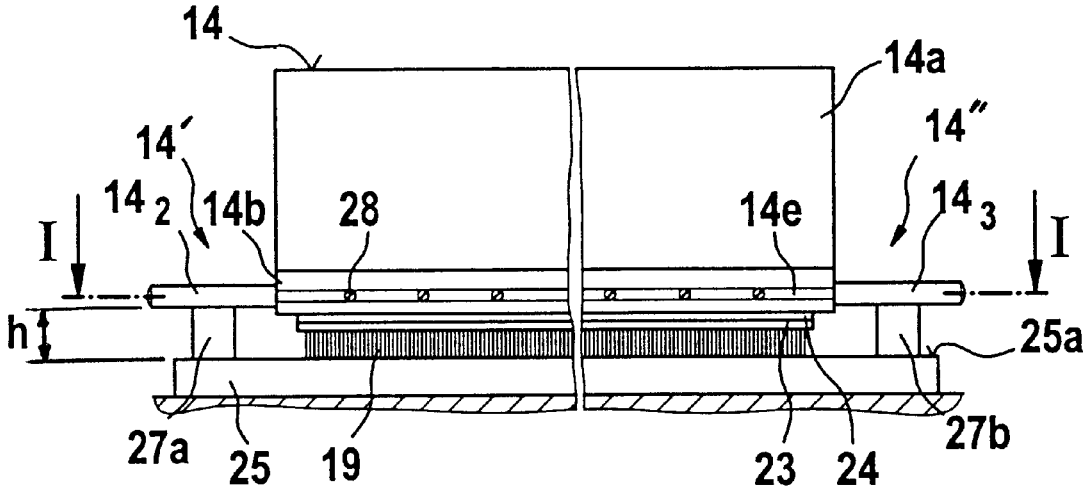
FIG. 6*a* is a side elevation view of an embodiment of the device according to the invention, with a mechanism for aligning the flat bar for attaching the equalizing layer.

FIG. 6*a* shows a leveling device for use in assembling the invention. A cube-shaped support element 27*a* with parallel and level surfaces and a height h is arranged between the flat bar pins $\mathbf{14}_1$, $\mathbf{14}_2$ and a surface 25*a* of a level plate 25. An additional cube-shaped support element 27*b* of the same height h is secured locally on the plate 25 and is arranged between the flat bar pins $\mathbf{14}_3$ and $\mathbf{14}_4$ and the plate 25. With this device and additional web elements on the side (not shown herein) or the like (for example, displaceable delimiting surfaces for the equalizing layer 24 and/or the support element 23), the points of the clothing 19 of the clothing strip 18 can be positioned on the plate 25 and the flat bar 14 with the pins $\mathbf{14}_1$, $\mathbf{14}_2$, $\mathbf{14}_3$, $\mathbf{14}_4$ can be positioned on the support elements 27*a*, 27*b*. The equalizing layer 24 is installed between the support 26 and the support element 23, for example by pouring it in, spraying it in, scraping it in, inserting it or the like. The equalizing layer 24, which may be doughy, distributes itself through the intermediate space and fills out this space for equalizing the distances.

Figure 6B:
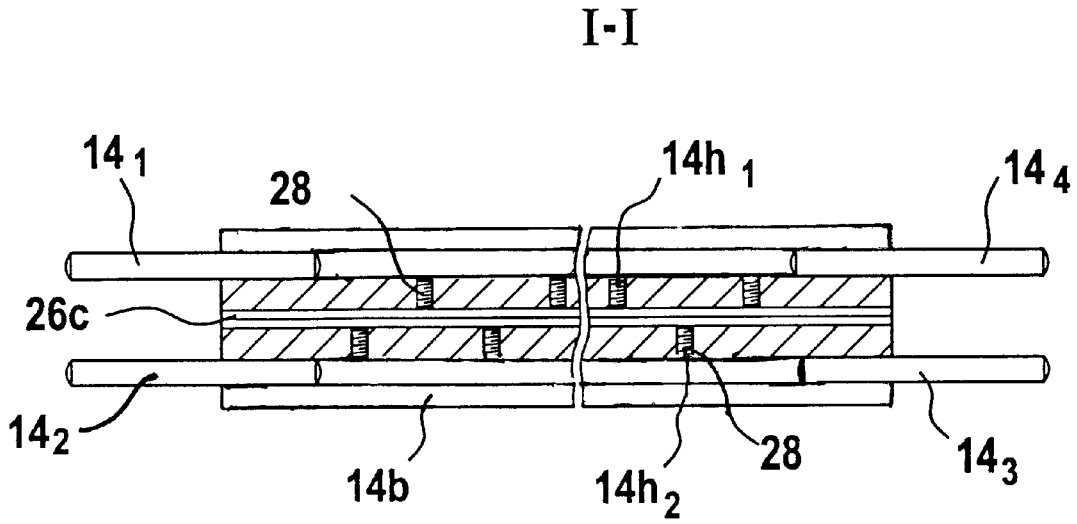
FIG. 6*b* is a sectional view along section line I–I in FIG. 6*a*.

With the embodiment of the invention according to FIGS. 6*a* and 6*b*, the bores $\mathbf{14}h_1$ and $\mathbf{14}h_2$ are arranged offset to each other. Opposite sides of the support body 14*b* are respectively provided with a plurality of threaded pins 28 which secure the extension 26*c* inside the longitudinal groove 14*i* (see FIG. 4).

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A flat bar for use in a carding machine, the carding machine having a roller with clothing, the flat bar being for arranging opposite the clothing on the roller, the flat bar comprising:

a flat bar support body having a width in a running direction of the flat bar and having a recess;

a clothing support having a first side and an extension that extends away from the first side, the extension extending into the recess and having a width in the running direction of the flat bar that is less than the width of the clothing support;

flat bar clothing attached to a second side of the clothing support, the second side being opposite the first side; and at least one fastening element that secures the extension of the clothing support in the recess.

2. The flat bar of claim 1, wherein the extension is at a right angle to the second side.

3. The flat bar of claim 1, wherein the clothing support is made of sheet metal.

4. The flat bar of claim 1, wherein the clothing support further comprises a bent section for holding the flat bar clothing.

5. The flat bar of claim 1, wherein the clothing support comprises two angled sheet-metal strips, each strip having an extension, and the extensions are attached to each other.

6. The flat bar of claim 1, wherein the flat bar support body has two recesses.

7. The flat bar of claim 1, wherein the recess is provided in the center of the flat bar support body.

8. The flat bar of claim 1, wherein the recess is a groove that is open on one side.

9. The flat bar of claim 1, wherein the recess extends an entire length of the flat bar support body.

10. The flat bar of claim 1, wherein the fastening element is detachable.

11. The flat bar of claim 10, wherein the fastening element is a screw element.

12. The flat bar of claim 11, wherein at least one bore is provided in the flat bar support body through which the screw element extends.

13. The flat bar of claim 11, wherein the screw element clamps down the extension of the first side of the clothing support.

14. The flat bar of claim 13, wherein the screw element pushes the extension of the first side of the clothing support against an opposite-arranged inside wall of the recess.

15. The flat bar of claim 1, wherein the flat bar clothing is a flexible clothing.

16. The flat bar of claim 15, wherein the flexible clothing comprises a supporting layer and clothing needles.

17. The flat bar of claim 1, wherein the flat bar clothing is attached to the clothing support by a glue.

18. The flat bar of claim 1, further comprising an equalizing layer positioned between the clothing support and the flat bar clothing, wherein the equalizing layer compensates for differences in a distance between an underside of the flat bar support body and the flat bar clothing such that the flat bar clothing is parallel to a running direction of the flat bar.

19. The flat bar of claim 1, wherein the first side of the clothing bar support is connected form fittingly to the flat bar support body.

20. A flat bar for use in a carding machine, the carding machine having a roller with clothing, the flat bar being for arranging opposite the clothing on the roller, the flat bar comprising:

a flat bar support body having a recess;

a clothing support having a first side, the first side being positioned in the recess;

flat bar clothing attached to a second side of the clothing support, the second side being opposite the first side; and at least one fastening element that secures the first side of the clothing support in the recess, wherein the clothing support comprises two angled sheet-metal strips, each strip having an extension, and the extensions are attached to each other.

21. A flat bar for use in a carding machine, the carding machine having a roller with clothing, the flat bar being for arranging opposite the clothing on the roller, the flat bar comprising:

a flat bar support body having two recesses;

a clothing support having a first side, the first side being positioned in the recesses;

flat bar clothing attached to a second side of the clothing support, the second side being opposite the first side; and at least one fastening element that secures the first side of the clothing support in the recesses.

22. A flat bar for use in a carding machine, the carding machine having a roller with clothing, the flat bar being for arranging opposite the clothing on the roller, the flat bar comprising:

a flat bar support body having a recess;

a clothing support having a first side, the first side being positioned in the recess;

flat bar clothing attached to a second side of the clothing support, the second side being opposite the first side;

at least one fastening element that secures the first side of the clothing support in the recess; and an equalizing layer positioned between the clothing support and the flat bar clothing, wherein the equalizing layer compensates for differences in a distance between an underside of the flat bar support body and the flat bar clothing such that the flat bar clothing is parallel to a running direction of the flat bar.

* * * * *